US008529217B2

(12) United States Patent
Alfes et al.

(10) Patent No.: US 8,529,217 B2
(45) Date of Patent: Sep. 10, 2013

(54) METHOD FOR OPERATING A COMPRESSOR DEVICE AND ASSOCIATED COMPRESSOR DEVICE

(75) Inventors: Ludger Alfes, Dorsten (DE); Wolfgang Zacharias, Duisburg (DE)

(73) Assignee: Siemens Aktiengesellschaft, Munich (DE)

( * ) Notice: Subject to any disclaimer, the term of this patent is extended or adjusted under 35 U.S.C. 154(b) by 645 days.

(21) Appl. No.: 12/744,764

(22) PCT Filed: Oct. 30, 2008

(86) PCT No.: PCT/EP2008/064731

§ 371 (c)(1),
(2), (4) Date: May 26, 2010

(87) PCT Pub. No.: WO2009/068407

PCT Pub. Date: Jun. 4, 2009

(65) Prior Publication Data

US 2010/0303639 A1 Dec. 2, 2010

(30) Foreign Application Priority Data

Nov. 30, 2007 (EP) ..... 07023293

(51) Int. Cl.

| | |
|---|---|
| ***F04B 39/04*** | (2006.01) |
| ***F04B 43/12*** | (2006.01) |
| ***F25D 17/02*** | (2006.01) |
| ***B01D 9/04*** | (2006.01) |

(52) U.S. Cl.

USPC ..... 417/228; 417/53; 417/372; 417/423.8; 62/99; 62/536

(58) Field of Classification Search

USPC ..... 417/228, 372, 423.8, 53; 62/50.1, 62/118, 119, 99, 430, 536, 292, 77, 298

See application file for complete search history.

(56) References Cited

U.S. PATENT DOCUMENTS

| | | | | |
|---|---|---|---|---|
| 2,423,436 | A | 7/1947 | Blom | |
| 4,614,482 | A * | 9/1986 | Gaffal | 417/367 |
| 7,185,431 | B1 * | 3/2007 | Seagar et al. | 29/888.02 |
| 2004/0025519 | A1 * | 2/2004 | Inoue et al. | 62/6 |
| 2007/0212232 | A1 | 9/2007 | De Larminat | |

FOREIGN PATENT DOCUMENTS

| | | | |
|---|---|---|---|
| CN | 1091831 | C | 10/2002 |
| DE | 20011217 | U1 | 10/2000 |
| EP | 0550381 | A1 | 7/1993 |
| EP | 1482179 | A1 | 12/2004 |
| WO | WO 9429597 | A1 | 12/1994 |
| WO | WO 9853182 | A1 | 11/1998 |
| WO | WO 0073621 | A1 | 12/2000 |
| WO | WO 2004036052 | A1 | 4/2004 |
| WO | WO 2005003512 | A1 | 1/2005 |
| WO | WO 2007055589 | A1 | 5/2007 |
| WO | WO 2007110281 | A1 | 10/2007 |

* cited by examiner

*Primary Examiner* — Charles Freay

(57) ABSTRACT

A method for operating a compressor device and associated compressor device including a compressor chamber and a cooling chamber adjoining the compressor chamber is provided. The pressure of a cooling medium in the cooling chamber is held above the pressure of a compressor medium in the compressor chamber during operation of the compressor device.

16 Claims, 1 Drawing Sheet

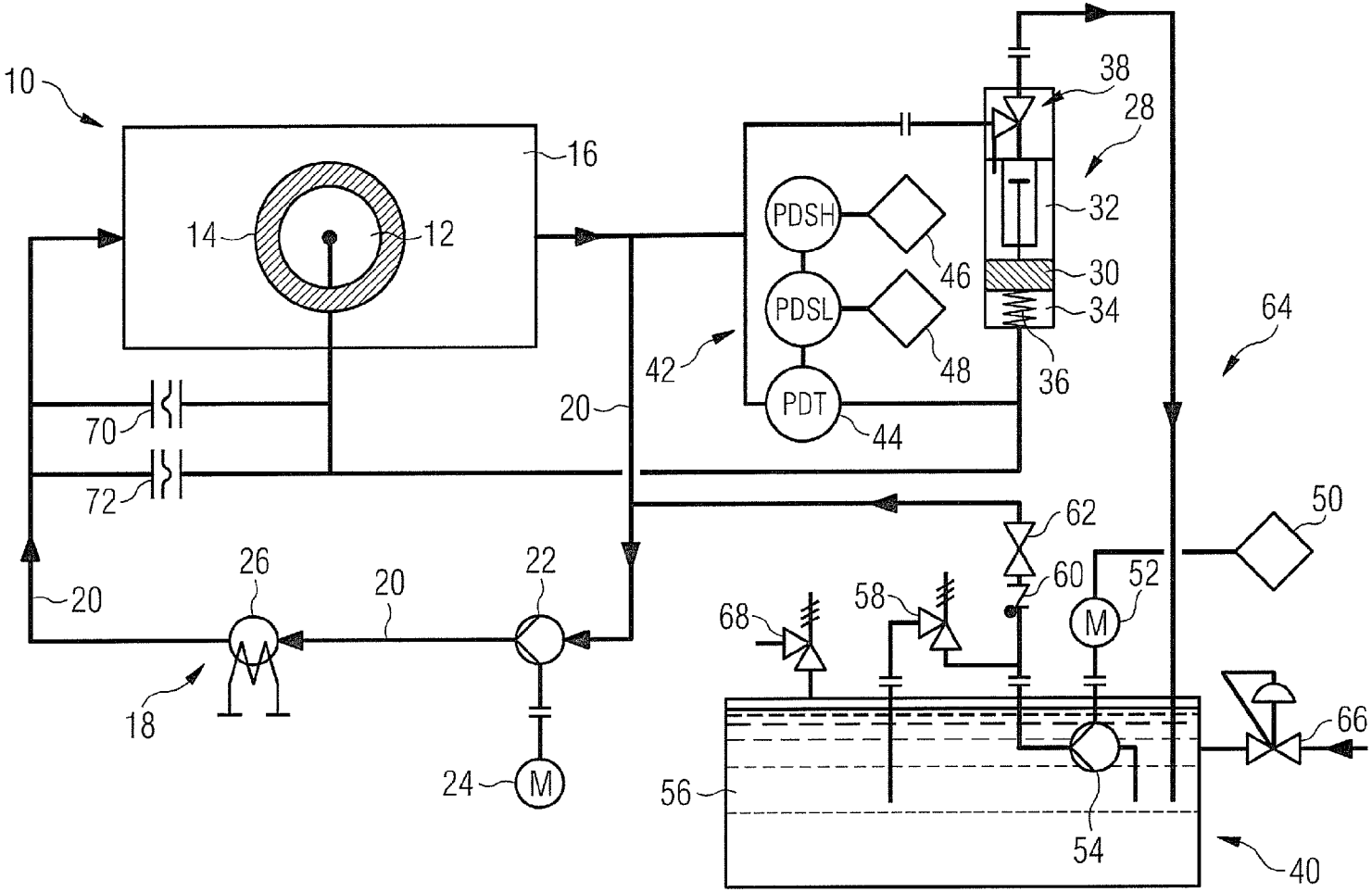
10
12
14
16
18
20
22
24
26
28
30
32
34
36
38
40
42
44
46
48
50
52
54
56
58
60
62
64
66
68
70
72
PDSH
PDSL
PDT
M
M

METHOD FOR OPERATING A COMPRESSOR DEVICE AND ASSOCIATED COMPRESSOR DEVICE

CROSS REFERENCE TO RELATED APPLICATIONS

This application is the US National Stage of International Application No. PCT/EP2008/064731, filed Oct. 30, 2008 and claims the benefit thereof. The International Application claims the benefits of European Patent Office application No. 07023293.9 EP filed Nov. 30, 2007. All of the applications are incorporated by reference herein in their entirety.

FIELD OF INVENTION

The invention refers to a method for operating a compressor device and to a compressor device with an electric drive, a compressor chamber and a cooling chamber which adjoins the compressor chamber, in which the compressor chamber is enclosed by a partition in the form of a tube which is provided between an electric stator of the drive and the rotor, which partition encapsulates the compressor chamber in relation to a cooling chamber, and in which the cooling chamber is part of a cooling device and contains a cooling medium which by means of a cooling circuit line can be transported out of and into this cooling chamber, wherein the cooling medium serves for dissipating heat which develops primarily as a result of a stator section of the electric drive.

BACKGROUND OF INVENTION

In known compression devices or compressor devices, it is customary to cool the compressor chamber and for this purpose to provide a cooling chamber which adjoins the compressor chamber. Thus, in known compressor devices with a common pressure casing for drive and compressor it is known to provide a comparatively thin partition for separating a compressor medium in the compressor chamber from the cooling medium in the adjoining cooling chamber. This partition can be a tube, for example, which is to be provided in a compressor device between its electric stator and the rotor. Such a tube should be designed as thin as possible for achieving the desired electrical functionality. Such a thin-walled tube, however, is limited in its pressure stability so that any hazard potential with regard to the existing pressure situation between compressor chamber and cooling chamber has to be excluded.

So that operation can be carried out with comparatively thin-walled tubes, even in the case of high compressor pressures, it is known to hold the pressure of the cooling medium, by means of a piston accumulator, lower than or equal to the compressor pressure. A system of this type, as is known for example from EP 1 482 179 B1, is very costly to adjust, however, and can possibly be seriously impaired in its function as a result of an inclusion of gases, such as air, in the media.

A multiphase pump for undersea operation is already known from WO 98/53182, in which a pressure compensating system ensures a positive pressure drop between a lubricating and cooling fluid and the process medium, wherein the driving electric motor is separated from the delivery pump by means of a shaft seal and the drive-side volume is filled completely with the lubricating and cooling fluid. WO 00/73621 A1, WO 2007/055589 A1, WO 2005/003512 A1, U.S. Pat. No. 2,423,436, and EP 0 550 381 A1 also deal with pumps or compressors which have a drive which is separated from the fluid flow unit by means of a seal so that the process fluid which is to be delivered does not come into contact with the drive. Such seals are expensive, especially with high demands for leak tightness. A compressor unit, in which a stator of an electric drive is separated from a compressor chamber by means of a cylindrical partition, is known from WO 2007/110281 A1. The strength requirements for such a partition are hard to fulfill, especially at a high pressure level, by means of conventional materials which also fulfill the requirement profile with regard to behavior in the electrical field and to chemical resistance.

SUMMARY OF INVENTION

It is an object of the present invention to create a method for operating a compressor device and an associated compressor device, in which the aforementioned problems are solved in a cost-effective manner and in which overall a compressor which is to be operated in a risk-free manner, even for high compression pressures, is created. The solution according to the invention is to be applicable especially for compressor devices in the oil and gas industry.

The object is achieved according to the invention with a method for operating a compressor device according to the claims and a compressor device according to the claims. Advantageous developments of the solution according to the invention are described in the dependent claims.

According to the invention, the object is achieved by means of a method and a compressor device according to the independent claims. The dependent claims which are referred back to in each case contain advantageous developments of the invention.

By means of the solution according to the invention, the pressure of the cooling medium during operation of the compressor device is held above the pressure of the compression or compressor medium. According to the invention, it is consequently ensured that even in the case of leakages on a partition between compressor chamber and cooling chamber no gas can escape from the compressor device into the cooling medium. The compressor device according to the invention is protected particularly well with regard to the hazard situation on the partition between compressor chamber and cooling chamber. The gas volume of the compressor chamber is more reliably sealed as a result of the higher pressure in the cooling chamber and in the associated cooling circuit.

According to the invention, especially temperature-induced and/or pressure-induced volume changes in the cooling chamber are preferably compensated by means of a compensating device by admitting and releasing cooling media into or from the cooling chamber. In addition to the protecting of the pressure situation in the cooling chamber which is achieved therewith, the type of system according to the invention and the associated method are also independent with regard to the actual size or the volume of the cooling circuit of the compressor device. Regardless of whether there is a large or a small volume of the cooling circuit, the volume can always be completely filled by means of the compensating device according to the invention.

In the solution according to the invention, furthermore, gas bubbles are preferably dissipated from the cooling medium by means of a deaeration device. This deaeration device also contributes towards the safeguarding of the pressure according to the invention in the cooling chamber, which is higher in comparison to the compressor chamber.

According to the invention, the aforementioned compensating device is furthermore preferably designed with a differential pressure controller for controlling the pressure difference between the cooling chamber and the compressor chamber and has a control piston and a control valve which can be operated by this. In this case, the pressure of the compressor or the pressure which prevails in the compressor chamber advantageously acts upon the control piston on one side. On the other side of the control piston, especially the pressure of the cooling medium is applied, which pressure, so that it can be held higher than the pressure in the compressor chamber, is increased by means of a force which acts additionally on the control piston.

The pressure differential controller in this case is especially preferably designed with a control piston which has a first piston chamber, which is connected to the cooling chamber in a fluid-conductive manner, and a second piston chamber, which is connected to the compressor chamber in a fluid-conductive manner, and in which the control piston, on the side of the second piston chamber, is spring-preloaded in the direction towards the first piston chamber. The spring-preloading of this type creates in the first piston chamber a pressure increase in comparison to the second piston chamber, so that in this way the pressure of the cooling medium, as provided according to the invention, is held higher than the pressure of the compressor medium.

The compensating device according to the invention is furthermore preferably designed with a differential pressure measuring device for measuring the pressure difference between the cooling chamber and the compressor chamber. The differential pressure measuring device determines said pressure difference during operation of the compressor device according to the invention and generates a signal so that in the case of a small pressure difference or no pressure difference cooling medium in the cooling circuit is admitted into the cooling chamber by the aforesaid compensating device.

For this, the compensating device is preferably designed with a pressure generator for delivering cooling medium into the cooling chamber, which pressure generator, as explained above, can be operated especially by the differential pressure measuring device.

Furthermore, the compensating device is preferably designed with a pressure bleed for bleeding off cooling medium from the cooling chamber, which pressure bleed can be operated especially by the aforesaid control piston. As a pressure bleed, an overpressure valve and/or a safety valve can also be advantageously provided on the pressure generator. For protecting the compressor device according to the invention, so-called differential pressure protectors are also advantageously provided between the pressure side of the cooling medium and the pressure side of the compressor medium and, in the case of an increased pressure difference between these two sides of a compressor according to the invention, ensure a pressure balance after a prespecified pressure threshold by means of a movable wall.

BRIEF DESCRIPTION OF THE DRAWINGS

An exemplary embodiment of the solution according to the invention is explained in more detail below, with reference to the attached schematic drawings.

The FIGURE shows a greatly schematized functional diagram of an exemplary embodiment of a compressor device according to the invention.

DETAILED DESCRIPTION OF INVENTION

A compressor device 10 is designed in the form of a turbocompressor and in this case has a compressor chamber 12 with a drive (not shown) of the turbocompressor partially integrated therein. In the compressor chamber 12, there is a compressor medium (not illustrated in more detail).

The compressor chamber 12 is enclosed by a partition 14 in the form of a tube which encapsulates the compressor chamber 12 in relation to a cooling chamber 16. The cooling chamber 16 is part of a cooling device 18 and contains a cooling medium (not illustrated in more detail) which by means of a cooling circuit line 20 can be transported out of and into this cooling chamber 16. The cooling medium in this case serves for dissipating heat which develops primarily as a result of the stator section of the electric drive. For this, a cooling pump 22, with an associated cooling pump drive 24, and also a cooler 26 are connected in series into the cooling circuit line 20.

A differential pressure control device 28, which has a control piston 30, is provided on the compressor device 10. The control piston 30 separates a first piston chamber 32 from a second piston chamber 34, wherein the pressure of the cooling medium is applied in the first piston chamber 32 and the pressure of the compressor medium is applied in the second piston chamber 34. In the second piston chamber 34, there is furthermore a spring element 36 by means of which the control piston 30 is displaced by spring action in the direction of the first piston chamber 32. In this way, a higher pressure prevails in the first piston chamber 32 in comparison to the second piston chamber 34.

A valve 38, by means of which cooling medium can be released from the cooling circuit line 20, can furthermore be operated by the control piston 30. This releasing takes place if the volume of the cooling medium in the cooling circuit line 20 in the section between the cooling chamber 16 and the cooling pump 22 expands (particularly on account of heating of the cooling medium). Expansion like this of the cooling medium leads to the control piston 30 being displaced in the direction towards the second piston chamber 34 and, as a result, to the valve 38 being opened. The valve 38 then opens a line to a replenishment and storage device 40, through which line cooling medium can flow out.

In the installed state, the valve 38 is arranged in the system at the highest point. Consequently, it is ensured that the valve 38 undertakes the function of a deaeration device and that the system is deaerated via the valve 38. A differential pressure-measuring device 42 is provided for recording the pressure difference between the first piston chamber 32 and the second piston chamber 34 by a measurement technique. For this purpose, the differential pressure-measuring device 42 has a measuring instrument 44 and a signal generator 46 of a predefined upper measurement threshold, and also a signal generator 48 of a predefined lower measurement threshold. If the pressure difference between the first piston chamber 32 and the second piston chamber 34 drops below the value of the lower measurement threshold, the signal generator 48 generates an electrical signal which is directed to a control device 50 of a replenishment-pump drive 52. The replenishment-pump drive 52 is part of a replenishment pump 54 by means of which cooling medium can be admitted from a storage tank 56 of the replenishment and storage device 40, past a safety valve 58, through a check valve 60 and a shut-off element component 62, into the cooling circuit line 20.

The safety valve 58 protects the replenishment and storage device 40, and essentially the extending line downstream of the pump 54, against overpressure in this case, for example in the case of the check valve 60 being closed or shut-off component being closed, whereas the check valve 60 prevents a return flow of cooling medium from the cooling medium circuit line 20 back into the storage tank 56 while the replenishment pump 54 is inoperative.

The cooling medium is introduced by means of the replenishment pump 54 into the cooling circuit line 20 between the cooling chamber 16 and the cooling pump 22 so that as a result the pressure in the cooling chamber 16 and also in the first piston chamber 32 is increased. This increase of pressure is carried out until the upper measurement threshold for the pressure difference between the first piston chamber 32 and the second piston chamber 34 is determined by the signal generator 46.

In this way, the differential pressure control device 28 with its valve 38, the differential pressure measuring device 42, and also the replenishment and storage device 40 with its replenishment pump 54, together form a compensating device 64 by means of which it is ensured that during operation of the compressor device 10 the pressure of the cooling medium in the cooling chamber 16 is held above the pressure of the compressor medium in the compressor chamber 12.

Finally, a control valve 66 is additionally provided on the replenishment and storage device 40 for admitting nitrogen into the storage tank 56, which takes place in the case of cooling media which react sensitively to air moisture or air oxygen, or which are to be shielded against an external atmosphere. An overpressure valve 68, which is furthermore provided on the storage tank 56, protects the storage tank 56 against overpressure in this case.

Furthermore, two differential pressure protectors 70 and 72 are additionally interposed between the cooling chamber 16 and the compressor chamber 12 and in the case of an excessive pressure difference between the compressor chamber 12 and the cooling chamber 16 on both sides (i.e. once in the direction of the compressor chamber 12 and once in the direction of the cooling chamber 16) can form a pressure balance after a predefined pressure threshold.

The invention claimed is:

1. A method for operating a compressor device with an electric drive, comprising:

providing a compressor chamber and a cooling chamber which adjoins the compressor chamber, enclosing the compressor chamber by a partition in the form of a tube; and encapsulating the compressor chamber using the partition in relation to a cooling chamber, wherein the cooling chamber is part of a cooling device and comprises a cooling medium which may be transported out of and into the cooling chamber using a cooling circuit line, wherein the cooling medium serves for dissipating heat which develops primarily as a result of a stator section of the electric drive, and wherein during operation of the compressor device, a first pressure of the cooling medium in the cooling chamber is held above a second pressure of a compressor medium in the compressor chamber, wherein a differential pressure device measures a pressure difference between the cooling chamber and the compressor chamber.

2. The method as claimed in claim 1, wherein temperature induced and/or pressure induced volume changes in the cooling chamber are compensated for using a compensating device, and wherein the compensation is achieved by admitting and releasing the cooling medium into or from the cooling chamber.

3. The method as claimed in claim 2, wherein the compensating device is designed with a pressure generator for delivering cooling medium into the cooling chamber.

4. The method as claimed in claim 2, wherein the compensating device is designed with a pressure bleed for bleeding off cooling medium from the cooling chamber.

5. The method as claimed in claim 1, wherein a plurality of gas bubbles are dissipated from the cooling medium using a deaeration device.

6. The method as claimed in claim 1, wherein a differential pressure controller controls the pressure difference between the cooling chamber and the compressor chamber, and wherein the differential pressure controller includes a control piston and a control valve, and wherein the control piston and the control valve are operated by the differential pressure controller.

7. The method as claimed in claim 6, wherein the control piston includes a first piston chamber, which is connected to the cooling chamber in a fluid-conductive manner, and a second piston chamber, which is connected to the compressor chamber in a fluid-conductive manner, and wherein on a side of the second piston chamber, the second piston chamber is spring-preloaded in a direction towards the first piston chamber.

8. The method as claimed in claim 1, wherein two differential pressure protectors are connected between the cooling chamber and the compressor chamber in order to form a pressure balance.

9. A compressor device with an electric drive, comprising:

a compressor chamber; and a cooling chamber which adjoins the compressor chamber, wherein the compressor chamber is enclosed by a partition in the form of a tube, wherein the partition encapsulates the compressor chamber in relation to the cooling chamber, wherein the cooling chamber is part of a cooling device and comprises a cooling medium which may be transported out of and into the cooling chamber using a cooling circuit line, wherein the cooling medium serves for dissipating heat which develops primarily as a result of a stator section of the electric drive, and wherein provision is made for a means for holding a first pressure of a cooling medium in the cooling chamber above a second pressure of a compressor medium in the compressor chamber during operation of the compressor device, wherein the means is designed with a differential pressure device for measuring a pressure difference between the cooling chamber and the compressor chamber.

10. The compressor device as claimed in claim 9, wherein the means is designed with a differential pressure controller for controlling the pressure difference between the cooling chamber and the compressor chamber, and wherein the differential pressure controller includes a control piston and a control valve, and wherein the control piston and the control valve are operated by the differential pressure controller.

11. The compressor device as claimed in claim 10, wherein the control piston includes a first piston chamber, which is connected to the cooling chamber in a fluid-conductive manner, and a second piston chamber, which is connected to the compressor chamber in a fluid-conductive manner, and wherein on a side of the second piston chamber, the second piston chamber is spring-preloaded in a direction towards the first piston chamber.

12. The compressor device as claimed in claim 9, wherein the means is designed with a compensating device for admitting and releasing cooling medium into or from the cooling chamber in order to compensate for temperature-induced and/or pressure-induced volume changes of the cooling medium in the cooling chamber.

13. The compressor device as claimed in claim 12, wherein the compensating device is designed with a pressure generator for delivering cooling medium into the cooling chamber.

14. The compressor device as claimed in claim 12, wherein the compensating device is designed with a pressure bleed for bleeding off cooling medium from the cooling chamber.

15. The compressor device as claimed in claim 9, wherein the means is designed with a deaeration device in order to dissipate a plurality of gas bubbles from the cooling medium.

16. The compressor device as claimed in claim 9, wherein two differential pressure protectors are connected between the cooling chamber and the compressor chamber in order to form a pressure balance.

* * * * *